US012741312B2

(12) United States Patent
Akizawa et al.

(10) Patent No.: US 12,741,312 B2
(45) Date of Patent: Sep. 22, 2026

(54) COPPER PARTICLES AND METHOD FOR MANUFACTURING SAME

(71) Applicant: MITSUI KINZOKU COMPANY, LIMITED, Tokyo (JP)

(72) Inventors: Mizuki Akizawa, Shimonoseki (JP); Hitohiko Ide, Shimonoseki (JP); Takafumi Sasaki, Shimonoseki (JP)

(73) Assignee: MITSUI KINZOKU COMPANY, LIMITED (JP)

( * ) Notice: Subject to any disclaimer, the term of this patent is extended or adjusted under 35 U.S.C. 154(b) by 380 days.

(21) Appl. No.: 18/282,269

(22) PCT Filed: Feb. 2, 2022

(86) PCT No.: PCT/JP2022/004116
§ 371 (c)(1),
(2) Date: Sep. 15, 2023

(87) PCT Pub. No.: WO2022/209267
PCT Pub. Date: Oct. 6, 2022

(65) Prior Publication Data

US 2024/0139804 A1 May 2, 2024

(30) Foreign Application Priority Data

Mar. 30, 2021 (JP) ..... 2021-058788

(51) Int. Cl.
*C22C 9/00* (2006.01)
*B22F 1/054* (2022.01)
*B22F 9/24* (2006.01)

(52) U.S. Cl.
CPC ..... *B22F 1/0551* (2022.01); *B22F 1/056* (2022.01); *B22F 9/24* (2013.01); *C22C 9/00* (2013.01);
(Continued)

(58) Field of Classification Search
CPC ..... C22C 1/0425; C22C 9/00; B22F 1/0551; B22F 1/056; B22F 1/07; B22F 2301/10;
(Continued)

(56) References Cited

U.S. PATENT DOCUMENTS

2007/0209425 A1* 9/2007 Shibata ..... B01D 65/102 210/500.36
2007/0209475 A1 9/2007 Sakaue et al.
2020/0122236 A1* 4/2020 Yoshida ..... H01B 1/22

FOREIGN PATENT DOCUMENTS

JP 2005-314755 A 11/2005
JP 2008-50650 A 3/2008
(Continued)

OTHER PUBLICATIONS

Yong Moo Shin et al., "Formation of Sub-Micrometer-Sized Cu Particles by Wet Chemical Processing Under Air Using Hydrazine Hydrate." Journal of Nanoscience and Nanotechnology, 2016, vol. 16, pp. 11523-11528 (6 pages).
(Continued)

*Primary Examiner* — Jie Yang
(74) *Attorney, Agent, or Firm* — Harness, Dickey & Pierce, P.L.C.

(57) ABSTRACT

Copper particles are provided mainly containing a copper element. In the copper particles, a ratio (S1/B) of a first crystallite size S1 to a particle size B is 0.23 or less, where the first crystallite size is obtained using Scherrer equation from a full width at half maximum of a peak derived from (111) plane of copper in X-ray diffraction measurement, and the particle size is calculated from a BET specific surface area. In the copper particles, a ratio (S1/S2) of the first crystallite size S1 to a second crystallite size S2 is 1.35 or less, where the second crystallite size is obtained using Scherrer equation from a full width at half maximum of a
(Continued)

(a) Example 1

(b) Example 2 peak derived from (220) plane of copper in X-ray diffraction measurement. A method for manufacturing the copper particles is also provided.

8 Claims, 3 Drawing Sheets

(52) U.S. Cl.
CPC ..... *B22F 2301/10* (2013.01); *B22F 2304/058* (2013.01); *B22F 2998/10* (2013.01); *B22F 2999/00* (2013.01)

(58) Field of Classification Search
CPC ..... B22F 2304/058; B22F 2998/10; B22F 2999/00; B22F 9/24
See application file for complete search history.

(56) References Cited

FOREIGN PATENT DOCUMENTS

| | | | |
|---|---|---|---|
| JP | 2012-041592 | A | 3/2012 |
| JP | 2012117146 | A | 6/2012 |
| JP | 2015-168878 | A | 9/2015 |
| WO | 2014/104032 | A1 | 7/2014 |

OTHER PUBLICATIONS

J. G. Ahn et al., "Effect of Na4O7P2 on Cu powder preparation from Cu2O-water slurry system", Journal of Colloid and Interface Science, 2008, vol. 319, pp. 109-114 (6 pages).
International Search Report (English and Japanese) issued in PCT/JP2022/004116, mailed Apr. 26, 2022; ISA/JP (7 Pages).

* cited by examiner (a) Example 1

(b) Example 2

(c) Example 3

(d) Example 4

(a) Comparative Example 1

(b) Comparative Example 2

(c) Comparative Example 3

(a) Example 2・Before sintering (b) Example 2・After sintering

COPPER PARTICLES AND METHOD FOR MANUFACTURING SAME

CROSS REFERENCE TO RELATED APPLICATIONS

This application is a 371 U.S. National Phase of International Application No. PCT/JP2022/004116, filed on Feb. 2, 2022, which claims priority to Japanese Patent Application No. 2021-058788, filed Mar. 30, 2021. The entire disclosures of the above applications are incorporated herein by reference.

BACKGROUND

Technical Field

The present invention relates to copper particles and a method for manufacturing the same.

Related Art

The applicant of the present invention has previously proposed a technique regarding flat copper particles each having a substantially hexagonal contour in plan view (see JP 2012-041592A). These copper particles have the advantages of high packing density and low surface roughness of the resulting conductor.

The particles of the technique described in JP 2012-041592A have high crystallinity, and thus there is room for improvement in order to achieve sintering at even lower temperatures.

Therefore, an object of the present invention is to provide copper particles that can be sintered at a low temperature.

SUMMARY

The present invention is directed to copper particles mainly including a copper element, wherein a ratio (S1/B) of a first crystallite size S1 to a particle size B is 0.23 or less, the first crystallite size being obtained using Scherrer equation from a full width at half maximum of a peak derived from (111) plane of copper in X-ray diffraction measurement, and the particle size being calculated from a BET specific surface area, and a ratio (S1/S2) of the first crystallite size S1 to a second crystallite size S2 is 1.35 or less, the second crystallite size being obtained using Scherrer equation from a full width at half maximum of a peak derived from (220) plane of copper in X-ray diffraction measurement.

The present invention is directed to a method for manufacturing copper particles, comprising:

a first reduction step of reducing copper ions, thereby producing cuprous oxide; and a second reduction step of reducing the cuprous oxide, thereby producing copper particles, wherein polyphosphoric acid with two or more phosphoric acid units or a salt of the polyphosphoric acid is allowed to be present in a reaction system during or before the second reduction step.

DETAILED DESCRIPTION

Figure 1A:
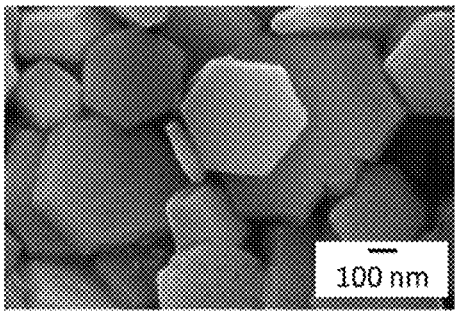
FIGS. 1(*a*) to 1(*d*) are scanning electron microscope images of copper particles before sintering in Examples 1 to 4, respectively.
Figure 1B:
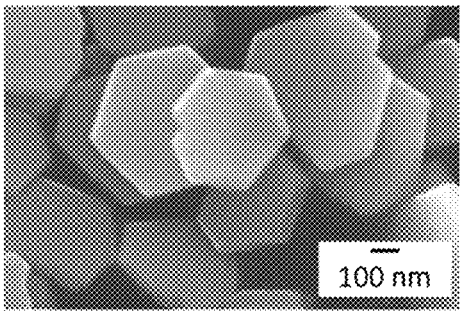
Figure 1C:
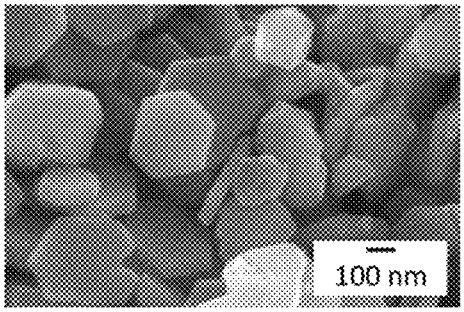
Figure 1D:
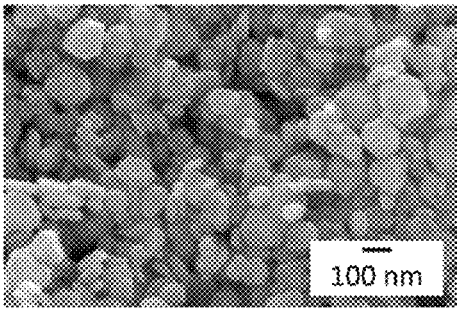

Hereinafter, the present invention will be described based on a preferred embodiment thereof. Copper particles of the present invention mainly contain a copper element. In the copper particles, there is a predetermined relationship regarding a crystallite size on a specific crystal plane calculated through X-ray diffraction measurement.

The phrase "mainly contain a copper element" means that a content of the copper element in the copper particles is 50 mass % or more, preferably 80 mass % or more, more preferably 98 mass % or more, and even more preferably 99 mass % or more. The content of the copper element can be measured using ICP optical emission spectrometry, for example.

The copper particles contain a copper element and elements other than the copper element, or are constituted by a copper element and do not contain elements other than the copper element except for unavoidable impurities. The copper particles are preferably in the latter form, that is, are preferably constituted by a copper element. However, as long as the effects of the present invention are not impaired, it is acceptable for the copper particles to contain trace amounts of unavoidable impurity elements such as an oxygen element. In either form, a content of elements other than the copper element in the copper particles is preferably 2 mass % or less. The content of these elements can be measured using ICP optical emission spectrometry, for example.

The copper particles of the present invention preferably have a predetermined relationship between a particle size calculated from a BET specific surface area thereof and a crystallite size calculated from an X-ray diffraction peak derived from (111) plane of copper.

Specifically, when the particle size calculated from the BET specific surface area is taken as a particle size B and the crystallite size calculated from a diffraction peak derived from the (111) plane of copper in X-ray diffraction measurement is taken as a first crystallite size S1, a ratio (S1/B) of the first crystallite size S1 to the particle size B is preferably 0.23 or less, more preferably from 0.02 to 0.23, and even more preferably from 0.05 to 0.23.

The diffraction peak derived from the (111) plane of copper is a peak with the greatest height in an X-ray diffraction pattern obtained through X-ray diffraction measurement of the copper particles of the present invention. Therefore, the first crystallite size is larger than the crystallite size calculated from the diffraction peaks derived from other crystal planes, and is also considered to be representative of crystallinity. Thus, it is inferred that there are many crystal grain boundaries in a single particle due to the configuration of the first crystallite size S1 being small relative to the particle size B. As a result, the thermal energy applied when the particles are heated is likely to destabilize the crystallite interfaces, resulting in active atomic diffusion, enhancing the fusion between particles at a low temperature, and improving the low-temperature sinterability.

Such copper particles can be obtained using a manufacturing method described below, for example.

The particle size B calculated from the BET specific surface area is preferably from 100 nm to 500 nm, more preferably from 100 nm to 400 nm, and even more preferably from 120 nm to 400 nm. The particle size B within this range can enhance the thermal conductivity and effectively improve the low-temperature sinterability.

The particle size B can be measured under the following conditions based on the BET method. Specifically, the particle size can be measured according to the nitrogen adsorption method using a "Macsorb" manufactured by Mountech Co., Ltd. The amount of powder to be measured is set to 0.2 g and the pre-degassing condition is set to 80° C. for 30 minutes under vacuum. The particle size B is calculated from the measured BET specific surface area using Formula (I) below.

In Formula (I), d is the particle size B [nm], A is the specific surface area [$m^2/g$] measured by the BET single-point method, and p is the density of copper [$g/cm^3$].

$$d = 6000/(A \times \rho) \quad \text{(I)}$$

The first crystallite size S1 is preferably from 10 nm to 60 nm, more preferably from 20 nm to 60 nm, and even more preferably from 25 nm to 55 nm. The crystallite size S1 within this range can facilitate the formation of even more crystal grain boundaries in a single particle, which further enhances the fusion of particles during heating and effectively improves the low-temperature sinterability.

Furthermore, in the copper particles, when the crystallite size obtained using Scherrer equation from a full width at half maximum of a peak derived from (220) plane of copper in X-ray diffraction measurement is taken as a second crystallite size S2, a ratio (S1/S2) of the first crystallite size S1 to the second crystallite size S2 is preferably smaller than or equal to a predetermined value.

Specifically, the S1/S2 ratio is preferably 1.35 or less, more preferably from 0.1 to 1.35, and even more preferably from 0.1 to 1.2.

Since metallic copper tends to have a face-centered cubic crystal structure, the copper particles of the present invention each have (111) plane of copper on a specific face of the particle surface and a copper (220) plane on the face that intersects the (111) plane. A smaller S1/S2 ratio indicates that the copper particles are not growing in the (111) plane direction or are growing in the (220) plane direction. Therefore, the fact that S1/S2 is within the predetermined range mentioned above is generally correlated with the fact that the copper particles of the present invention each have an anisotropic particle shape such as a flat shape. The flat shape means a shape having a pair of main faces that face each other and a side face that intersects these main faces. When each copper particle has a flat shape, it is presumed that the (111) plane of copper exists on a main face of the copper particle and the (220) plane of copper exists on the side face of the copper particle.

Therefore, the S1/S2 ratio within the above-mentioned range facilitates the contact between main faces of particles or side faces of particles when the particles are aligned during sintering, and thus the contact areas between the particles tend to be the same crystal plane. Particles to which thermal energy is applied have higher thermal energy utilization efficiency and atoms at the crystallite interface are more easily diffused when they are in contact with each other on the same crystal face than when they are in contact with each other on different crystal faces. As a result, the fusion of particles with each other at a low temperature can be enhanced, and the low-temperature sinterability can be improved. This is advantageous in that the sinterability can be further improved compared with spherical particles or mechanically manufactured flat copper particles.

Such copper particles can be obtained using the manufacturing method described below, for example.

The second crystallite size S2 is preferably from 10 nm to 60 nm, more preferably from 20 nm to 50 nm, and even more preferably from 30 nm to 50 nm. The crystallite size S2 within this range enables formation of many conductive paths derived from the shape of the copper particles while improving the low-temperature sinterability resulting from a relatively small crystallite size, thereby enabling formation of a low-resistance conductor after sintering.

In the copper particles of the present invention, when the crystallite size obtained using Scherrer equation from a full width at half maximum of a peak derived from (311) plane of copper in X-ray diffraction measurement is taken as a third crystallite size S3, a ratio (S1/S3) of the first crystallite size S1 to the third crystallite size S3 is preferably smaller than or equal to a predetermined value.

Specifically, the S1/S3 ratio is preferably 1.35 or less, more preferably from 0.2 to 1.30, and even more preferably from 0.5 to 1.25.

Since metallic copper tends to have a face-centered cubic crystal structure, the copper particles of the present invention each have (111) plane of copper on a specific face of the particle surface and (311) plane of copper on the face that intersects the (111) plane. A smaller S1/S3 ratio indicates that the copper particles are not growing in the (111) plane direction or are growing in the (311) plane direction. Therefore, the fact that S1/S3 is within the predetermined range mentioned above is generally correlated with the fact that the copper particles of the present invention have an anisotropic particle shape such as a flat shape. In this case, it is presumed that the (111) plane of copper exists on a main face of each copper particle and the (311) plane of copper exists on the side face of the copper particle.

Therefore, the S1/S3 ratio within the above-mentioned range facilitates the contact between main faces of particles or side faces of particles when the particles are aligned during sintering, and thus the contact areas between the particles tend to be the same crystal plane. As a result, when the particles are heated, atomic diffusion at the crystallite interfaces is activated, and thus the fusion between particles at a low temperature can be enhanced, and the low-temperature sinterability can be improved. This is advantageous in that the sinterability can be further improved compared with spherical particles or mechanically manufactured flat copper particles.

Such copper particles can be obtained using the manufacturing method described below, for example.

The third crystallite size S3 is preferably from 10 nm to 60 nm, more preferably from 20 nm to 50 nm, and even more preferably from 30 nm to 50 nm. The crystallite size S3 within this range enables the formation of many conductive paths derived from the shape of the copper particles while improving the low-temperature sinterability resulting from a relatively small crystallite size, thereby enabling the formation of a low-resistance conductor after sintering.

The first crystallite size S1, the second crystallite size S2, and the third crystallite size S3 can be respectively calculated using Scherrer equation below from the full widths at half maximum of the diffraction peaks derived from the (111), the (220), and the (311) planes of copper obtained in X-ray diffraction measurement. The conditions of the X-ray diffraction measurement are described in detail in the examples below. The PDF number 00-004-0836 is used.

Scherrer equation: $D=k\lambda/\beta \cos \theta$

D: Crystallite size k: Scherrer's constant (0.94)

k: X-ray wavelength

β: Full width at half maximum [rad]

θ: Diffraction angle

A content of the carbon element contained in the particle is preferably small. Specifically, the content of the carbon element in the copper particles is preferably 1000 ppm or less, more preferably 900 ppm or less, and even more preferably 800 ppm or less. The smaller the content, the better, but the realistic content is 100 ppm or more. The content of the carbon element within this range can relatively suppress sintering inhibition caused by organic matters on the surface of the copper particles. Such copper particles can be manufactured using the manufacturing method described below, for example.

The content of the carbon element can be measured using gas analysis or combustion carbon analysis, for example. In measuring the content of the carbon element, it is first determined whether or not the particle surface is coated. This can be confirmed using X-ray photoelectron spectroscopy (XPS), nuclear magnetic resonance (NMR), Raman spectroscopy, infrared spectroscopy, liquid chromatography, time-of-flight secondary ion mass spectrometry (TOF-SIMS), or other methods, alone or in combination, for example. If it is determined using this method that coating treatment has been performed on the particle surface, qualitative and quantitative analysis is performed to determine the type and amount of elements contained in the coating layer formed by the coating treatment, using the above-listed methods alone or in a combination of two or more. In addition to this, thermogravimetry (TG) can be used to measure the mass change that occurs before and after the firing temperature and the amount of carbon after heating to that temperature, thereby evaluating the physical properties of the organic matters.

If it is determined that coating treatment has not been performed on the particle surface, the copper particles to be measured are subjected directly to the measurement, and the quantitative value obtained is used as the carbon element content in the copper particles.

A content of the phosphorus element contained in the particle is preferably within a predetermined range. Specifically, the content of the phosphorus element in the copper particles is preferably 300 ppm or more, more preferably from 300 to 1500 ppm, and even more preferably from 300 to 1000 ppm. The content of the phosphorus element within this range can generate a melting point drop while sufficiently maintaining the conductivity of copper, thereby further improving the sinterability at a low temperature. Such copper particles can be manufactured using the manufacturing method described below, for example. The presence and content of phosphorus elements in the copper particles can be measured using ICP optical emission spectrometry, for example.

As long as the effects of the present invention are achieved, there is no particular limitation on the shape of the copper particles of the present invention, but the particles preferably have a flat shape when manufactured using the method described below. Such particles each have a plate-like shape with a pair of substantially flat main faces that face each other and a side face that intersects these main faces, in which the maximum length of the main faces is larger than the thickness. In this case, it is also preferable that, when the main faces in the copper particles are viewed in plan view, the shape has a contour defined by a combination of straight lines or a combination of straight and curved lines.

Next, a preferable method for manufacturing the copper particles described above will be described. This manufacturing method has two reduction steps consisting of: a first reduction step of reducing copper ions, thereby producing cuprous oxide; and a second reduction step of reducing the cuprous oxide in the presence of polyphosphoric acid with two or more phosphoric acid units or a salt thereof (hereinafter referred to as polyphosphoric acids), thereby producing copper particles.

The polyphosphoric acids are caused to be present in a reaction system during or before the second reduction step. That is to say, the polyphosphoric acids may be caused to be present in a reaction system during or before the first reduction step, and the second reduction step may be performed in that state. Alternatively, the polyphosphoric acids may not be caused to be present in a reaction system in the first reduction step, but may be caused to be present in the reaction system after the first reduction step and during or immediately before the second reduction step.

In this manufacturing method, from the viewpoint of achieving uniform control of the reduction reaction, improvement of productivity of the resulting copper particles, and lower production cost, it is preferable to perform both reduction steps under wet conditions in which reduction is allowed to occur in an aqueous solution, and it is also preferable to perform both reduction steps in the same reaction system. The following is an example of a manufacturing method using the same reaction system under wet conditions.

First, a reaction solution containing a copper source and a reducing compound is prepared and the first reduction step is performed to reduce copper ions to produce cuprous oxide in the solution. The reaction solution may be prepared by adding the raw materials to the solvent simultaneously or by adding the raw materials to the solvent in any order.

From the viewpoint of facilitating the control of the reduction reaction of copper ions and improving handleability during the manufacture, it is preferable to pre-mix the copper source and solvent to form a copper-containing solution, and then add a reducing compound in a solid form or a solution in which the reducing compound is dissolved in advance in a solvent, to the copper-containing solution. The reducing compound may be added in a batch or sequentially.

In the first reduction step, the polyphosphoric acids may or may not be contained in the reaction solution as described above. If the polyphosphoric acids are caused to be present in the reaction solution, it is preferable to add the copper source, the polyphosphoric acids, and the reducing compound in that order to effectively control the reduction of copper ions using the reducing compound and the crystal growth.

Water and lower alcohols such as methanol, ethanol, and propanol can be used as solvents in the reaction solution. These solvents can be used alone or in a combination of two or more.

The copper source used in the first reduction step may be a compound that produces copper ions in the reaction solution, and water-soluble copper compounds are preferred. Specific examples of such copper sources include copper organic acid salts such as copper formate, copper acetate, and copper propionate, copper inorganic acids such as copper nitrate and copper sulfate, and other various copper compounds. These copper compounds may be anhydrous or hydrated. These copper compounds can be used alone or in a combination of two or more.

A content of the copper source in the reaction solution in the first reduction step is preferably from 0.5 to 5 mol/L, and more preferably from 1 to 4 mol/L, expressed as the molar concentration of the copper element. The content within this range enables manufacture of copper particles with a small particle size and a small crystallite size on a specific crystal plane with high productivity.

The reducing compound is preferably a water-soluble compound. Specific examples of such a reducing compound include hydrazine compounds such as hydrazine, hydrazine hydrochloride, hydrazine sulfate, and hydrazine hydrate, boron compounds and their salts such as sodium borohydride and dimethylamine borane, sulfur oxalates such as sodium sulfite, sodium hydrogen sulfite, and sodium thiosulfate, nitrogen oxalates such as sodium nitrite and sodium hyponitrite, and oxo acids of phosphorous and their salts such as phosphorous acid, sodium phosphite, hypophosphorous acid, and sodium hypophosphite. These reducing compound may be anhydrous or hydrated. These reducing compounds can be used alone or in a combination of two or more.

From the viewpoint of facilitating the control of the reduction product in the first reduction step to be cuprous oxide, thereby facilitating the control of the copper particle growth in the subsequent reduction step to obtain particles with a predetermined crystallite size, and from the viewpoint of suppressing unintended inclusion of impurities such as carbon elements after the reduction, it is preferable to use a hydrazine compound, and more preferable to use anhydride or hydrate of hydrazine, as the reducing compound in the reducing solution.

A content of the reducing compound in the reaction solution in the first reduction step is preferably from 0.5 to 3.0 moles, and more preferably from 1.0 to 2.0 moles, per mole of copper element. The concentration of the reducing compound controlled within this range enables the control of the progress of the reduction reaction of copper ions and the grain growth as appropriate, thereby enabling manufacture of copper particles with a small particle size and a small crystallite size on a specific crystal plane with high productivity.

The reaction solution in the first reduction step is preferably acidic with a pH at 25° C. of 3.5 to 5.5, in order to control the degree of reducibility as appropriate such that the reduction to cuprous oxide proceeds but the reduction to metallic copper does not proceed when a reducing compound, in particular a hydrazine compound is used, and in order to facilitate anisotropic copper crystal growth that proceeds in the second reduction step. In the first reduction step, it is preferable to add the reducing compound after adjusting the pH, in order to control the degree of reduction of copper ions as appropriate.

As long as the effects of the present invention are achieved, the pH can be adjusted by using various acids or basic substances or by causing the polyphosphoric acids to be present in the reaction solution. In particular, the use of the polyphosphoric acids in the pH adjustment is advantageous in that the subsequent reaction can be caused to occur efficiently without adding other substances to the reaction system, thereby preventing unintended inclusion of impurities and efficiently obtaining the desired copper particles.

The reduction reaction in the first reduction step may be performed with the reaction solution in an unheated state or in a heated state. In either case, the temperature of the reaction solution is preferably from 5 to 35° C., and more preferably from 10 to 30° C. The reaction time in the first reduction step is preferably from 0.1 to 3 hours, and more preferably from 0.2 to 2 hours, provided that the temperature is within the temperature range mentioned above. From the viewpoint of uniformity of the reduction reaction, it is also preferable to continue stirring the reaction solution from the start of the reaction to the end of the reaction.

Subsequently, the second reduction step of reducing the cuprous oxide obtained in the first reduction step, thereby producing metallic copper particles. It is preferable to perform the second reduction step under wet conditions as with the first reduction step, and it is more preferable to perform both reduction steps in the same reaction system.

As described above, the polyphosphoric acids are preferably caused to be present in the reaction system during or before the second reduction step.

The polyphosphoric acids for use in this manufacturing method may be polyphosphoric acid having preferably two to eight phosphoric acid monomer units and more preferably two to five phosphoric acid monomer units in the structure such as diphosphoric acid ($H_4P_2O_7$), triphosphoric acid (tripolyphosphoric acid, $H_5P_3O_{10}$), or tetrapolyphosphoric acid ($H_6P_4O_{13}$), or their salts. The polyphosphoric acid salts may be alkali metal salts, alkaline-earth metal salts, other metal salts, ammonium salts, or the like. These substances can be used alone or in a combination of two or more.

A content of the polyphosphoric acids in the second reduction step is preferably from 0.001 to 0.05 moles, and more preferably from 0.001 to 0.01 moles, per mole of copper element. The concentration of the polyphosphoric acids set within this range can facilitate anisotropic copper crystal growth resulting from the reduction reaction of cuprous oxide, thereby enabling manufacture of copper particles with a small particle size and a small crystallite size on a specific crystal plane with high productivity.

If the polyphosphoric acids are caused to be present in the first reduction step, since the polyphosphoric acids are not consumed in the reaction in the first reduction step and the concentration of the polyphosphoric acids does not substantially change before and after the first reduction step, the amount of polyphosphoric acids suitable for the reduction to metallic copper and the grain growth in the second reduction step can be sufficiently achieved by adding polyphosphoric acids in the concentration range mentioned above to the reaction system in the first reduction step.

In the second reduction step, the reduction to metallic copper can be caused to occur by adding the reducing compound mentioned above. The content of the reducing compound in the reaction solution in the second reduction step is preferably from 3 to 15 moles, and more preferably from 4 to 13 moles, per mole of copper element. If the second reduction step is performed in the same reaction system as that of the first reduction step, it is preferable to add more reducing compounds to the solution to the above mentioned content from the viewpoint of both improving the reducibility and controlling impurity suppression. It is also preferable to use the same type of reducing compound in the reduction steps.

The concentration of the reducing compound controlled within this range can sufficiently facilitate the reduction reaction to metallic copper, thereby enabling manufacture of copper particles with a small particle size and a small crystallite size on a specific crystal plane with high productivity.

The reducing compound in the second reduction step may be added in a batch or sequentially. From the viewpoint of efficiently obtaining copper particles that satisfy the crystallite size ratio and particle size mentioned above, sequential addition is preferred.

The reaction solution in the second reduction step is preferably non-acidic (neutral or alkaline) with a pH at 25° C. of 7.0 or more, in order to facilitate efficient reduction of copper ions and cuprous oxide remaining in the reaction solution to metallic copper when a reducing compound, in particular a hydrazine compound is used, and in order to facilitate anisotropic copper crystal growth. It is preferable to adjust the pH before adding a reducing compound in the second reduction step, in order to control the degree of reduction of copper ions as appropriate. The pH can be adjusted by using various acids or basic substances.

If the second reduction step is performed in the same reaction system as that of the first reduction step, the pH of the reaction solution is preferably adjusted by adding a basic substance such as sodium hydroxide or potassium hydroxide because the reaction solution after the first reduction step is acidic. In the second reduction step, it is preferable to add the reducing compound after adjusting the pH, in order to efficiently reduce copper ions and cuprous oxide to metallic copper.

From the viewpoint of efficiently facilitating the reduction of copper ions and cuprous oxide in the reaction solution and obtaining copper particles with a predetermined crystallite size with high productivity, it is preferable to heat the reaction solution in the second reduction step. It is preferable to heat the reaction solution such that the temperature is maintained at 30 to 80° C., especially 30 to 50° C. from the start of the second reduction step, that is, from when the reducing compound is added to the end of the reaction. The reaction time is preferably from 60 to 180 minutes under the temperature conditions mentioned above. It is also preferable to continue stirring the reaction solution from the start of the reaction to the end of the reaction from the viewpoint of causing the reduction reaction to occur uniformly and obtaining copper particles with a small variation in particle size.

The inventor of the present invention presumes as follows as to why, in this manufacturing method, it is possible to obtain copper particles that can achieve low temperature sinterability, by performing the two-step reduction step in which copper ions are reduced to cuprous oxide and then to metallic copper, and by causing the polyphosphoric acids to be present during the second reduction step.

First, in the first reduction step, copper ions are reduced by the reducing compound in the reaction solution, and very small particles of cuprous oxide are formed in the reaction solution. Then, in the second reduction step, monovalent copper ions eluted from the cuprous oxide particles are reduced to form metallic copper nuclei. Since these nuclei are highly unstable, they repeatedly coalesce with each other or re-dissolve in the reaction solution, and the particles eventually grow. If the polyphosphoric acids are present during this particle growth, the polyphosphoric acids adsorb on a specific crystal plane of copper and inhibit growth in the direction of that crystal plane. On the other hand, the growth on a crystal plane where the polyphosphoric acids do not adsorb is not inhibited, and the growth proceeds in the direction of that crystal plane.

Based on the fact that metallic copper tends to have a face-centered cubic crystal structure and the results of X-ray diffraction measurements of the copper particles obtained, the crystal plane where the polyphosphoric acids adsorb is estimated to be the (111) plane of copper in the particles, and the crystal plane where the polyphosphoric acids do not adsorb is estimated to be the (220) plane of copper, which is perpendicular to the (111) plane of copper. Accordingly, it seems that anisotropic growth occurs in which the growth om the (111) plane of copper is suppressed and the growth on the (220) plane of copper proceeds, resulting in flat copper particles that can achieve low-temperature sinterability.

According to a suitable manufacturing method of the present invention, the reduction reaction is allowed to occur under acidic conditions, especially in the first reduction step, so that the reduction power can be controlled to the extent that copper ions can be reduced to cuprous oxide, but not to metallic copper. In addition to this, the subsequent metallic copper formation reaction can be easily controlled. Subsequently, non-acidic conditions can be used to lower the eluting rate of cuprous oxide and control the supply of monovalent copper ions. When the second reduction is allowed to occur in that environment, the rate of reduction to metallic copper can be adjusted to moderate conditions, thus controlling the nucleation growth rate, which is particularly advantageous.

The copper particles of the present invention obtained through the above-described steps, even when organic components that control crystal growth such as organic amines, amino alcohols, and reducing sugars are not contained, will satisfy the above-mentioned suitable crystallite size and ratio, suitable particle size, and suitable content of various elements such as carbon elements, and will also have a flat shape.

Furthermore, in the thus obtained copper particles, crystal planes of the crystals that exist on a main face and grow in the direction orthogonal to the main face and those that exist on the side face and grow in the direction along the main face respectively have specific orientation directions, and each crystal plane is uniformly formed in one direction. Therefore, when these copper particles are sintered in a state in which the main faces of the copper particles are in contact with each other or in which the side faces of the copper particles are in contact with each other, the energy required for fusion is not excessive due to the contact between uniformly aligned identical crystal surfaces, and sintering at a low temperature is possible.

The copper particles obtained through the above-described steps are subjected to washing and solid-liquid separation, as necessary, and which the copper particles may be used in the form of a slurry in which they are dispersed in a solvent such as water or an organic solvent, or may be dried and used in the form of a dry powder, which is a collection of the copper particles. In either case, the copper particles of the present invention have excellent low-temperature sinterability. The surface of the copper particles may be coated with organic matters such as fatty acids or their salts or inorganic matters such as silicon compounds as necessary in order to improve dispersion of the particles.

As long as the effects of the present invention are achieved, it is acceptable for the resulting copper particles to contain elements other than the copper element, such as trace amounts of substances formed through unavoidable oxidation of the surface of the particles.

The copper particles of the present invention can also be used in the form of a conductive composition such as a conductive ink or a conductive paste, in which the copper particles are further dispersed in an organic solvent, a resin, or the like.

When the copper particles of the present invention are used in the form of a conductive composition, the conductive composition contains at least the copper particles and an organic solvent. As the organic solvent, any organic solvents similar to those conventionally used in the technical field of conductive compositions containing a metal powder can be used without particular limitation. Examples of such organic solvents include monohydric alcohols, polyhydric alcohols, polyhydric alcohol alkyl ethers, polyhydric alcohol aryl ethers, polyethers, esters, nitrogen-containing heterocyclic compounds, amides, amines, and saturated hydrocarbons. These organic solvents can be used alone or in a combination of two or more.

At least one of a dispersant, an organic vehicle, and a glass frit may be further added to the conductive composition, as necessary. Examples of the dispersant include dispersants such as nonionic surfactants that do not contain sodium, calcium, phosphorus, sulfur, chlorine, and the like. Examples of the organic vehicle include mixtures containing a resin component such as an acrylic resin, an epoxy resin, ethyl cellulose, carboxyethyl cellulose, or the like and a solvent such as a terpene-based solvent such as terpineol or dihydroterpineol, an ether-based solvent such as ethyl carbitol or butyl carbitol, or the like. Examples of the glass frit include borosilicate glass, barium borosilicate glass, and zinc borosilicate glass.

A conductor film containing copper can be formed by applying the conductive composition to a substrate to form a coating film and heating and sintering the coating film. The conductor film can be suitably used, for example, to form a circuit of a printed wiring board or establish electrical continuity of an external electrode of a ceramic capacitor. For example, a printed wiring board made of a glass epoxy resin or the like or a flexible printed-circuit board made of polyimide or the like can be used as the substrate, according to the type of an electronic circuit in which the copper particles are used.

The amounts of the copper particles and the organic solvent in the conductive composition can be adjusted according to the specific use of the conductive composition and the method for applying the conductive composition, but the copper particle content in the conductive composition is preferably from 5 to 95 mass %, and more preferably from 20 to 90 mass %. As the coating method, for example, inkjet printing, spray coating, roll coating, gravure printing, and other methods performed in this technical field can be employed.

It is sufficient that the heating temperature (sintering temperature) at which the formed coating film is sintered is not lower than the sintering start temperature of the copper particles, and, for example, the heating temperature may be from 150 to 220° C. The atmosphere during heating may be, for example, an oxidizing atmosphere or a non-oxidizing atmosphere. An example of the oxidizing atmosphere is an oxygen-containing atmosphere. Examples of the non-oxidizing atmosphere include a reducing atmosphere such as hydrogen or carbon monoxide, a weakly reducing atmosphere such as a hydrogen-nitrogen mixed atmosphere, and an inert atmosphere such as argon, neon, helium, and nitrogen. Regardless of which atmosphere is used, the heating time is preferably from 1 minute to 3 hours, and more preferably from 3 minutes to 2 hours, provided that heating is performed in the above-described temperature range.

Since the resulting conductor film is obtained by sintering the copper particles of the present invention, even when sintering is performed under the conditions of a relatively low temperature, sintering can be proceeded sufficiently. Also, since the copper particles are fused even at a low temperature during sintering, the contact area between the copper particles or between the copper particles and the surface of a base material can be increased, and as a result, a sintered structure that has high adhesion to a bonding target and high density can be formed efficiently. Furthermore, the resulting conductor film has high conduction reliability.

EXAMPLES

Hereinafter, the present invention will be described in greater detail using examples. However, the scope of the present invention is not limited to the examples below.

Example 1

First Reduction Step

In this example, 2.5 kg of copper acetate monohydrate as a copper source and 5.0 g of sodium diphosphate as a polyphosphoric acid (with a molar ratio of 0.002 per mole of copper element) were placed into a stainless steel tank containing 5.0 liters of warm pure water and 5.0 liters of methanol, and stirred at a liquid temperature of 25° C. for 30 minutes so that these substances were dissolved.

Then, 235.0 g of hydrazine (with a molar ratio of 1.55 per mole of copper element) was added to the solution, and stirring was continued for 30 minutes without heating and at a liquid temperature of 25° C. to produce fine particles of cuprous oxide in the solution. After the formation of cuprous oxide, the reaction solution was stirred for 30 minutes.

Second Reduction Step

Subsequently, the pH of the solution was adjusted to 7.0 by adding 25% NaOH solution to the reaction solution in the first reduction step. The temperature of the liquid was then heated to 40° C., and 1900.0 g of hydrazine (with a molar ratio of 12.5 per mole of copper element) was quantitatively and successively added to the liquid over 10 minutes to perform the second reduction step. The temperature of the liquid was then cooled to 30° C., and stirring was continued over 150 minutes to obtain copper particles in which fine particles of cuprous oxide were reduced to metallic copper.

Decantation washing was performed on the resulting aqueous slurry of copper particles until the conductivity reached 1.0 mS (washed slurry).

The resulting slurry was filtered using a Nutsche filter. The solids thereby obtained were batch fed into 0.9 kg of methanol to replace the solvent. The solids were then dried to obtain a copper powder constituted by a collection of copper particles. The obtained copper particles had a copper element content of more than 98 mass % and a flat shape.

FIG. 1(*a*) shows a scanning electron microscope image of the copper particles in Example 1.

Examples 2 to 4

The type of polyphosphoric acid used was changed as shown in Table 1 below, and the liquid temperature at the time of adding hydrazine in the second reduction step was changed to 50° C. only in Example 4. Except for these conditions, the same conditions as those in Example 1 were used to obtain a copper powder constituted by a collection of copper particles. The obtained copper particles had a copper element content of more than 98 mass % and a flat shape.

FIGS. 1(*b*) to 1(*d*) respectively show scanning electron microscope images of the copper particles in Examples 2 to 4.

Comparative Example 1

Copper particles having a flat shape were obtained using the method described in Example 1 of JP 2012-041592A. The copper particles of this comparative example were manufactured using a manufacturing method without using polyphosphoric acid.

Specifically, 4 kg of copper sulfate pentahydrate, 120 g of aminoacetic acid, and 50 g of trisodium monophosphate were added to 6 liters of pure water at 70° C. and stirred. Pure water was further added to adjust the liquid volume to 8 L, and stirring was continued in this state for 30 minutes to obtain a copper-containing aqueous solution.

Then, 5.8 kg of 25% NaOH solution was added to the aqueous solution with continued stirring to produce fine particles of copper oxide in the solution. The solution was stirred in this state for 30 minutes.

Subsequently, 1.5 kg of glucose was added to the aforementioned aqueous solution, and the first reduction step was performed to reduce the copper oxide to cuprous oxide. The solution was stirred in this state for 30 minutes.

Then, 1 kg of hydrazine monohydrate and 3 g of sodium borohydride were added in a batch while the solution was stirred, and the second reduction step was performed to reduce the cuprous oxide to metallic copper. The stirring was continued for 1 hour to complete the reaction.

After the reaction was completed, decantation washing was performed on the resulting aqueous slurry of copper particles until the conductivity reached 1.0 mS (washed slurry).

The resulting slurry was filtered using a Nutsche filter. The solids thereby obtained were batch fed into 0.9 kg of methanol to replace the solvent, and then dried to obtain a copper powder constituted by a collection of copper particles.

Figure 2A:
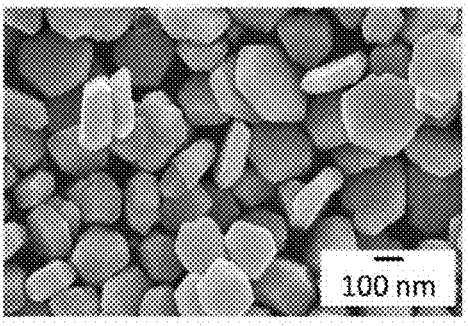
FIGS. 2(*a*) to 2(*c*) are scanning electron microscope images of copper particles before sintering in Comparative Examples 1 to 3, respectively.
Figure 2B:
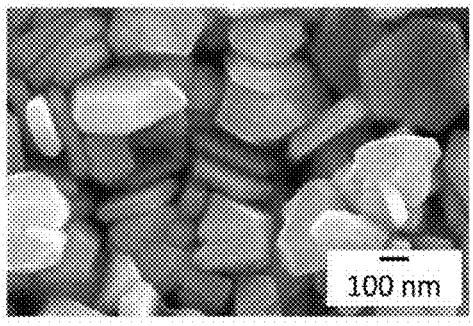
Figure 2C:
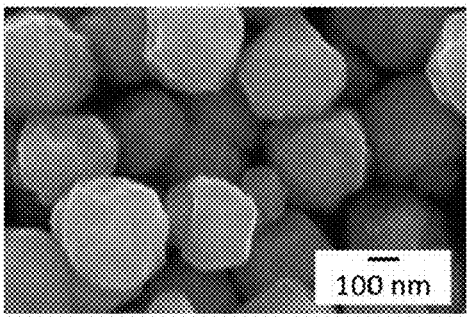

FIG. 2(*a*) shows a scanning electron microscope image of the copper particles in Comparative Example 1.

Comparative Example 2

Copper particles having a flat shape were obtained using the method described in Comparative Example 1 of JP 2012-041592A. The copper particles of this comparative example were manufactured using a manufacturing method without using polyphosphoric acid.

Specifically, 4 kg of copper sulfate pentahydrate, 120 g of aminoacetic acid, and 50 g of trisodium phosphate were added to 6 L of pure water at 70° C. and stirred. Pure water was further added to adjust the liquid volume to 8 L, and stirring was carried out for 30 minutes to obtain a copper-containing aqueous solution.

Next, 5.8 kg of 25% sodium hydroxide solution was added to the aqueous solution with continued stirring to produce cupric oxide in the solution. The solution was stirred in this state for 30 minutes, and then 1.5 kg of glucose was added and the first reduction step was performed to reduce the cupric oxide to cuprous oxide. After the solution was stirred in this state for 30 minutes, hydrazine monohydrate was added in a batch while the solution was stirred, and the stirring was continued for 1 hour to complete the reaction.

After the reaction was completed, decantation washing was performed on the resulting aqueous slurry of copper particles until the conductivity reached 1.0 mS (washed slurry).

The resulting slurry was filtered using a Nutsche filter. The solids thereby obtained were batch fed into 0.9 kg of methanol to replace the solvent, and then dried to obtain a copper powder constituted by a collection of copper particles.

FIG. 2(*b*) shows a scanning electron microscope image of the copper particles in Comparative Example 2.

Comparative Example 3

Copper particles of this comparative example were obtained using the following method. These copper particles each had a spherical shape. The copper particles of this comparative example were manufactured using a manufacturing method without using polyphosphoric acid.

Specifically, 4 kg of copper sulfate (pentahydrate) and 120 g of aminoacetic acid were dissolved in water to prepare 8 L (liters) of aqueous solution of copper salts at a liquid temperature of 60° C. Then, while stirring the solution, 6.55 kg of 25 wt % sodium hydroxide solution was added quantitatively over about 5 minutes, and the solution was stirred at a liquid temperature of 60° C. for 60 minutes and aged until the liquid color turned completely black to produce cupric oxide. The solution was then allowed to stand for 30 minutes, and 1.5 kg of glucose was added to reduce the cupric oxide to cuprous oxide through aging for 1 hour. Furthermore, 1 kg of hydrazine hydrate was added quantitatively over 1 minute to reduce the cuprous oxide to metallic copper to produce a copper powder slurry.

Decantation washing was performed on the resulting aqueous slurry of copper particles until the conductivity reached 1.0 mS (washed slurry).

The resulting slurry was filtered using a Nutsche filter. The solids thereby obtained were batch fed into 0.9 kg of methanol to replace the solvent, and then dried to obtain a copper powder constituted by a collection of copper particles.

FIG. 2(*c*) shows a scanning electron microscope image of the copper particles in Comparative Example 3.

Evaluation of Sinterability

The sinterability of the copper particles of the examples and the comparative examples were evaluated using the following method.

First, a 20 mass % aqueous slurry was prepared using the washed slurries of the copper particles of the examples and the comparative examples. Then, an isopropyl alcohol solution in which 12 g of copper laurate was dissolved as a surface coating treatment agent was added in a batch to the slurry heated at 50° C., and stirred for 1 hour. Then, the solids obtained through solid-liquid separation by filtration were vacuum-dried to obtain copper particles with surface coating treatment.

Subsequently, 8.5 g of the surface-coated copper particles and polyethylene glycol having a number average molecular weight of 200 were mixed using a three-roll kneader, and thus a conductive paste containing 85 mass % copper particles was obtained. The obtained paste was applied to a glass substrate, and the substrate was sintered in a nitrogen atmosphere at 190° C. for 10 minutes to form a conductor film on the glass substrate. The degree of fusing between the sintered copper particles in the conductor film was observed using an electron microscope, and the sinterability was evaluated based on the following evaluation criteria. Table 1 below shows the results.

Figure 3A:
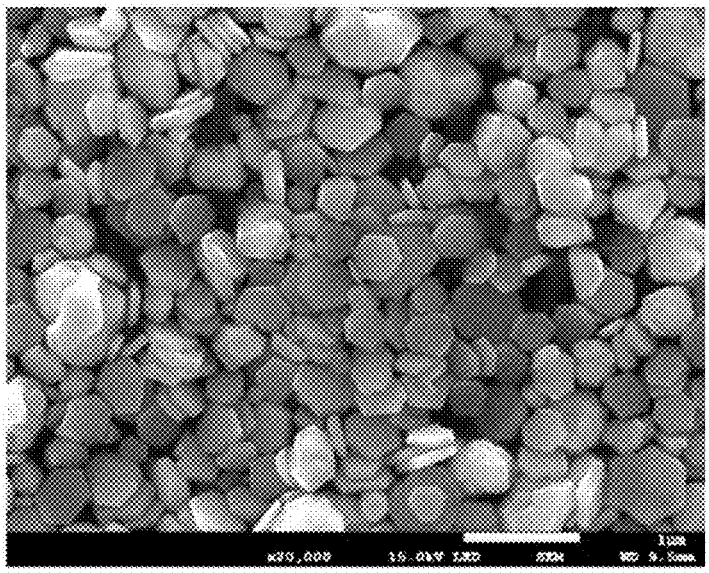
FIG. 3(*a*) is a scanning electron microscope image of copper particles before sintering in Example 2, and FIG. 3(*b*) is a scanning electron microscope image of copper particles after sintering in Example 2.
Figure 3B:
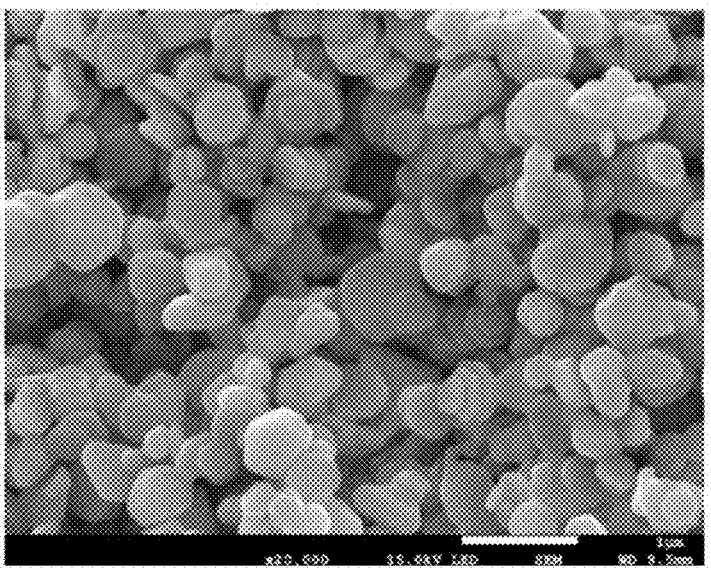

The scanning electron microscope image of the copper particles in Example 2 before sintering is shown in FIG. 3(*a*), and the scanning electron microscope image of the copper particles after sintering is shown in FIG. 3(*b*).

Evaluation Criteria of Sinterability

A: There are many areas where the interface between particles is indistinct, fusion between particles is confirmed, and the sinterability at a low temperature is excellent.

D: Particles are not fused, and the sinterability is poor.

Evaluation of Resistivity of Conductor Film

The resistivity of each conductor film formed in "Evaluation of Sinterability" above was measured using a resistivity meter (Loresta-GP MCP-T610, manufactured by Mitsubishi Chemical Analytech Co., Ltd.). The measurement was performed three times for each conductor film to be measured, and the arithmetic mean value of the measured values was used as the resistivity (μS2 cm) of that conductor film. The lower the resistivity, the lower the resistance of the conductor film. Table 1 below shows the results.

Calculation of Particle Size based on BET Specific Surface Area

The copper particles of the examples and the comparative examples were measured using the following method.

First, a 20 mass % aqueous slurry was prepared using the washed slurries of the copper particles of the examples and the comparative examples. Then, an isopropyl alcohol solution in which 12 g of copper laurate was dissolved as a surface coating treatment agent was added in a batch to the slurry heated at 50° C., and stirred for 1 hour. Then, the solids obtained through solid-liquid separation by filtration were vacuum-dried to obtain copper particles with surface coating treatment. The specific surface area of these particles was measured based on the BET single-point method using the measuring method based on the above-described BET method, and the particle diameter B was calculated based on the specific surface area. Table 1 below shows the results.

Measurement of Contents of Carbon and Phosphorus Elements

The content of the carbon element in the copper particles was measured by placing 0.50 g of copper particles of each of the examples and the comparative examples in a magnetic crucible and performing measurement using a carbon/sulfur analyzer (CS844 manufactured by LECO Japan Corporation) under the conditions that oxygen gas (with a purity of 99.5%) was used as the carrier gas and the analysis time was 40 seconds. Table 1 below shows the measurement results.

The content of the phosphorus element in the copper particles was measured by introducing a solution in which 1.00 g of copper particles of each of the examples and the comparative examples was dissolved in 50 mL of 15% nitric acid solution, into an ICP optical emission spectrometer (PS3520VDDII manufactured by Hitachi High-Tech Science Corporation). Table 1 below shows the measurement results.

Measurement of Crystallite Size

The copper particles of the examples and the comparative examples were measured using the following method.

First, a 20 mass % aqueous slurry was prepared using the washed slurries of the copper particles of the examples and the comparative examples. Then, an isopropyl alcohol solution in which 12 g of copper laurate was dissolved as a surface coating treatment agent was added in a batch to the slurry heated at 50° C., and stirred for 1 hour. Then, the solids obtained through solid-liquid separation by filtration were vacuum-dried to obtain copper particles with surface coating treatment. The copper powder was classified using a sieve with a 75 μm mesh opening, and the portion under the sieve was used as the sample. The sample was filled into a sample holder and measured using an X-ray diffractometer (Ultima IV manufactured by Rigaku Corporation) under the following conditions.

Then, among the diffraction peaks, the main peak at the position corresponding to the (220), (111) or (311) plane of copper was measured, and the crystallite sizes S1 and S2 and the S1/S2 ratio were calculated using Scherrer equation mentioned above from the full width at half maximum of the peak. The S1/B ratio was also calculated from the obtained crystallite sizes. Table 1 below shows the results.

X-Ray Diffraction Measurement Conditions

Tube: CuKα ray
Tube voltage: 40 kV
Tube current: 50 mA
Measurement diffraction angle: 2θ=2θ to 100°
Measurement step width: 0.01°
Collection time: 3 sec/step
Receiving slit width: 0.3 mm
Divergence vertical limit slit width: 10 mm
Detector: High-speed 1D X-ray detector D/teX Ultra250

Method for Preparing X-Ray Diffraction Sample

The copper powder to be measured was laid on a measurement holder and smoothed with a glass plate so that the copper powder was 0.5 mm thick and smooth.

The X-ray diffraction patterns obtained under the measurement conditions described above were analyzed using analytical software under the following conditions. The analysis was corrected for peak width using LaB6 values. The crystallite size was calculated using the full width at half maximum of the peak and Scherrer's constant (0.94).

Analysis Conditions for Measurement Data

Analysis software: PDXL2 manufactured by Rigaku
Smoothing: Gaussian function, smoothing parameter=10
Background removal: Fitting method
Kα2 removal: Intensity ratio 0.497
Peak search: Second derivative method
Profile fitting: FP method
Crystallite size distribution type: Lorentz model
Scherrer's constant: 0.9400

The peaks of the X-ray diffraction patterns used in the analysis are shown below. The Miller indices shown below are synonymous with the copper crystal planes described above.

Peak indexed by the Miller Index (220) around 20=71° to 76°
Peak indexed by the Miller Index (111) around 20=40° to 45°.
Peak indexed by the Miller Index (311) around 20=87.5° to 92.5°

TABLE 1

| | | | (111) Plane | | (220) Plane | (311) Plane | | | Elementary analysis | | Evaluation | |
|---|---|---|---|---|---|---|---|---|---|---|---|---|
| | Polyphosphoric acids | Particle size B [nm] | crystallite size S1 [nm] | S1/B ratio | crystallite size S2 [nm] | crystallite size S3 [nm] | S1/S2 ratio | S1/S3 ratio | Carbon content [ppm] | Phosphorus content [ppm] | Sinterability | Volume resistivity [μΩ · cm] |
| Ex. 1 | Diphosphoric acid | 337 | 37.2 | 0.11 | 31.2 | 32.6 | 1.19 | 1.14 | 434 | 463 | A | 70 |
| Ex. 2 | Triphosphoric acid | 375 | 52.1 | 0.14 | 48.8 | 45.6 | 1.07 | 1.14 | 417 | 366 | A | 20 |
| Ex. 3 | Polyphosphoric acid | 193 | 41.1 | 0.21 | 37.8 | 38.4 | 1.09 | 1.07 | 520 | 514 | A | 16 |
| Ex. 4 | Diphosphoric acid | 141 | 26.9 | 0.19 | 36.0 | 34.6 | 0.75 | 0.78 | 789 | 832 | A | 24 |
| Com. Ex. 1 | Not used | 182 | 46.5 | 0.25 | 43.5 | 44.9 | 1.07 | 1.04 | 2550 | 205 | D | Not measurable |
| Com. Ex. 2 | Not used | 293 | 71.7 | 0.24 | 61.7 | 56.7 | 1.16 | 1.26 | 1850 | 93 | D | Not measurable |
| Com. Ex. 3 | Not used | 260 | 49.0 | 0.19 | 33.0 | 30.9 | 1.48 | 1.59 | 2600 | <10 | D | Not measurable |

As shown in Table 1, compared with the copper particles of the comparative examples, the copper particles of the examples exhibited superior sinterability at a low temperature, and it can be seen that the conductor films obtained by sintering these copper particles had sufficiently low resistance.

INDUSTRIAL APPLICABILITY

According to the present invention, copper particles having excellent low-temperature sinterability are provided.

The invention claimed is:

1. Copper particles mainly comprising a copper element, wherein a ratio (S1/B) of a first crystallite size S1 to a particle size B is 0.23 or less, the first crystallite size being obtained using Scherrer equation from a full width at half maximum of a peak derived from (111) plane of copper in X-ray diffraction measurement, and the particle size being calculated from a Brunauer-Emmett-Teller specific surface area, a ratio (S1/S2) of the first crystallite size S1 to a second crystallite size S2 is 1.35 or less, the second crystallite size being obtained using Scherrer equation from a full width at half maximum of a peak derived from (220) plane of copper in X-ray diffraction measurement, the copper particles are flat-shaped, and the (111) plane of copper exists on a main face of the flat-shaped copper particles, and the (220) plane of copper exists on a side face of the flat-shaped copper particles.

2. The copper particles according to claim 1, wherein the particle size is from 100 nm to 500 nm.

3. The copper particles according to claim 1, wherein a ratio (S1/S3) of the first crystallite size S1 to a third crystallite size S3 is 1.25 or less, the third crystallite size being obtained using Scherrer equation from a full width at half maximum of a peak derived from (311) plane of copper in X-ray diffraction measurement.

4. The copper particles according to claim 1, wherein the copper particles contain a carbon element, and a content of the carbon element is 1000 ppm or less.

5. The copper particles according to claim 1, wherein the copper particles contain a phosphorus element, and a content of the phosphorus element is 300 ppm or more.

6. A method for manufacturing the copper particles according to claim 1, comprising:

a first reduction step of reducing copper ions, thereby producing cuprous oxide; and a second reduction step of reducing the cuprous oxide, thereby producing the copper particles, wherein polyphosphoric acid with two or more phosphoric acid units or a salt of the polyphosphoric acid is present in a reaction system during or before the second reduction step.

7. The method according to claim 6, wherein the first reduction step and the second reduction step are performed in a same reaction system.

8. The method according to claim 6, wherein the first reduction step of reducing the copper ions is performed in a first reaction solution, thereby the cuprous oxide is produced, and the first reaction solution is set in an acidic condition with a pH at 25C° of 3.5 to 5.5, and the second reduction step of reducing the cuprous oxide is performed in a second reaction solution, thereby the copper particles are produced, and the second reaction solution is set in one of a neutral condition and an alkaline condition with the PH at 25C° of 7.0 or more.

* * * * *